US010018026B2

(12) United States Patent
McBay

(10) Patent No.: US 10,018,026 B2
(45) Date of Patent: Jul. 10, 2018

(54) SYSTEM AND APPARATUS FOR GEOTHERMAL PYROLYSIS

(71) Applicant: David Alan McBay, Palo Alto, CA (US)

(72) Inventor: David Alan McBay, Palo Alto, CA (US)

(73) Assignee: David Alan McBay, Palo Alto, CA (US)

( * ) Notice: Subject to any disclaimer, the term of this patent is extended or adjusted under 35 U.S.C. 154(b) by 848 days.

(21) Appl. No.: 13/999,705

(22) Filed: Mar. 14, 2014

(65) Prior Publication Data

US 2014/0284045 A1 Sep. 25, 2014

Related U.S. Application Data

(60) Provisional application No. 61/852,206, filed on Mar. 15, 2013, provisional application No. 61/852,295, filed on Mar. 15, 2013, provisional application No. 61/852,218, filed on Mar. 15, 2013.

(51) Int. Cl.
*E21B 43/243* (2006.01)
*E21B 43/295* (2006.01)
*E21B 7/14* (2006.01)

(52) U.S. Cl.
CPC ..... *E21B 43/295* (2013.01); *E21B 7/14* (2013.01)

(58) Field of Classification Search
CPC ..... F24J 3/08; F24J 2003/088; E21B 43/295; E21B 43/243
USPC ..... 166/256, 257, 58
See application file for complete search history.

(56) References Cited

U.S. PATENT DOCUMENTS 894,675 A * 7/1908 Monroe et al. ..... A01D 31/00 171/102
2,035,382 A * 3/1936 Abele ..... E21B 36/008 166/169
4,209,303 A * 6/1980 Ricks ..... C10J 3/02 210/180
2009/0064583 A1* 3/2009 Bronshtein ..... C10B 19/00 48/111
2012/0067568 A1* 3/2012 Palmer ..... E21B 36/02 166/256
2012/0208254 A1* 8/2012 Smith ..... C12M 21/02 435/167

* cited by examiner

*Primary Examiner* — Giovanna C. Wright
(74) *Attorney, Agent, or Firm* — Perkins Coie LLP

(57) ABSTRACT

Herewith are methods and embodiment of an apparatus for using geothermal heat for pyrolysis. In some embodiments, a pyrolysis reaction chamber is lowered into a well, where the pyrolysis reaction can be driven by geothermal heat. In some embodiments the reaction chamber is connected to second chamber to contain the gas reaction products produced by the pyrolysis reaction. In some embodiments, the reaction chamber and the gas collection chamber are separated by some distance in the well, and are connected by a long hose or conduit. A spallation drilling apparatus is also disclosed that uses jets of hot fluid for drilling. This is compatible with drilling wells in high temperature zones, such as a lava dome. A simplified pyrolysis reactor for use in a lava dome is also disclosed, in which the dome functions to contain the reaction, and the apparatus to facilitate pyrolysis is far more compact.

11 Claims, 10 Drawing Sheets

SYSTEM AND APPARATUS FOR GEOTHERMAL PYROLYSIS

CROSS-REFERENCE TO RELATED APPLICATIONS

This patent application claims the benefit of U.S. Provisional Patent Application No. 61/852,295, entitled AN APPARATUS FOR GEOTHERMAL PYROLYSIS; U.S. Provisional Patent Application No. 61/852,206, entitled APPARATUS FOR SPALLATION DRILLING; and U.S. Provisional Patent Application No. 61/852,218, entitled APPARATUS FOR MAGMATIC FUEL GENERATION; all filed on Mar. 15, 2013, and all hereby incorporated by reference in their entirety

FIELD OF THE INVENTION

This invention relates to the field of pyrolysis, which is the thermo-chemical decomposition of carbon-containing matter into combustible solids and gases. In particular, this invention discloses a pyrolysis apparatus that can be used with geothermal wells and, in some cases, lava domes to convert carbon-based waste products to combustible fuel.

BACKGROUND OF THE INVENTION

Pyrolysis is a well-known process in which carbon-containing substances, often called a "biomass", such as agricultural by products, wood chips, human sewage, etc., are heated in the absence of oxygen to several hundred degrees Celsius. Without oxygen, the material does not burn. Instead, the carbon-based compounds separate into three distinct products—a solid, called "char", a combustible liquid, called "bio-oil", and a mixture of gasses such as hydrogen $H_2$, carbon monoxide CO and carbon dioxide $CO_2$, also known as "syngas". Most of the products of the pyrolysis reaction are combustible, and therefore pyrolysis is a process that converts what had simply been waste into useable fuels.

Pyrolysis occurs in the absence of oxygen, and therefore must be carried out in a special reactor chamber. The process can occur in a vacuum, or in the presence of gases such as water/steam, nitrogen or argon. The biomass can also be mixed with particles, such as sand, and stirred to increase the exposed surface area.

The proportion of the reaction products depends on several factors including the composition of the biomass and the process parameters. In some processes, the yield of bio-oil is optimized when the pyrolysis temperature is around 500° C. and the heating rate is high (i.e. 1,000° C./s). This is often called "fast pyrolysis". Processes that use slower heating rates are called "slow pyrolysis", and bio-char is usually the major product of such processes. Table I compares the properties of several types of pyrolysis and their reaction products. This table is adapted from Table 8-12 in the reference book by Donald L. Klass [*Biomass for Renewable Energy, Fuels, and Chemicals*, Academic Press, San Diego (1998)]. Pyrolysis is an active area research and development, and more can be found in texts such as the *Applied Pyrolysis Handbook*, edited by Thomas P. Wampler [CRC Press, Boca Raton, Fla. (2006)], or journals such as the *Journal of Analytical and Applied Pyrolysis,* edited by D. Fabbri, K. J. Voorhees and published by Elsevier (Amsterdam, NL).

TABLE I

Typical Biomass Pyrolysis Technologies, Conditions and Major Products (adapted from *Biomass for Renewable Energy, Fuels, and Chemicals* by D. L. Klass).

| Technology | Residence Time | Heating Rate | Temperature (° C.) | Major Products |
|---|---|---|---|---|
| Conventional Carbonization | Hours-days | Very low | 300-500 | Charcoal |
| Pressurized Carbonization | 15 min-2 h | Medium | 450 | Charcoal |
| Conventional Pyrolysis | Hours | Low | 400-600 | Char-oil & Syngas |
| | 5-30 min | Medium | 700-900 | Biochar & Syngas |
| Vacuum Pyrolysis | 2-30 sec | Medium | 350-450 | Oil |
| Flash Pyrolysis | 0.1-2 sec | High | 400-650 | Oil |
| | <1 sec | High | 650-900 | Oil & Syngas |
| | <1 sec | Very High | 1000-3000 | Syngas |

Pyrolysis is an endothermic process, and so a source of heat must be supplied. Typically, for a pyrolysis facility on the surface of the Earth, the heat is supplied by burning natural gas or some other fuel to heat a reactor chamber. In some cases, the syngas produced by the reaction is cycled back to provide additional fuel for the pyrolysis reactor.

Another source of heat lies beneath the surface of the Earth, in the form of geothermal energy. With the core of the Earth believed to be over 5,000° C., there is enough heat stored from the original formation of the Earth and generated by ongoing radioactive decay to provide all the energy mankind can use.

The usual problems encountered in attempting to utilize geothermal energy have been practical ones of access, since the surface of the Earth is much cooler than the interior. The average geothermal gradient is about 25° C. for every kilometer of depth. This means that the temperature at the bottom of a well 5 km deep can be expected to be at a temperature of 125° C. or more. Oil companies now routinely drill for oil at these depths, and the technology required to create holes of this magnitude in the Earth is well known. (The deepest oil well at this time is over 12 km deep.) Wells of this depth, however, can be very expensive, costing over $10M to drill.

However, near geological fault zones, fractures in the Earth's crust allow magma to come much closer to the surface. This gives rise to familiar geothermal landforms such as volcanoes, natural hot springs, and geysers. In the seismically active Long Valley Caldera of California, magma at a temperature more than 700° C. is believed to lie at a depth of only 6 km. Alternatively, if lower temperatures can be utilized, a well dug to a depth less than 1 km in a geothermal zone can achieve temperatures over 100° C. A well 1 km deep often can cost much less than $1M to drill.

It may, however, be unnecessary to drill a well of any kind. The worldwide search for oil has left a multitude of holes in the Earth, many going deep enough to tap into a significant source of heat. For these wells, all only surface infrastructures need be supplied to allow this source of heat to be tapped.

In a previous patent application entitled GEOTHERMAL ENERGY COLLECTION SYSTEM, U.S. patent application Ser. No. 13/815,266, submitted on Feb. 14, 2013 and incorporated herein in its entirety by reference, inventions by David Alan McBay, the inventor of the inventions disclosed here, are presented. These disclosed inventions comprise a system in which a thermal mass is lowered into a well to a Heat Absorption Zone, which will typically be a stratum of the Earth geothermally heated to 350° C. or more. While in this Zone, the temperature of the thermal mass rises because it is surrounded by the Earth's heat. Once hot, this thermal mass is then raised again to the surface, and the heat transferred in a Heat Transfer Zone to a suitable means for driving an industrial process, such as the generation of electricity or powering a chemical reaction.

A facility designed to lower and raise thermal masses according to the previous invention can also serve as a facility to carry out pyrolysis, assuming that the temperature in the Heat Absorption Zone is hot enough to drive the desired pyrolysis reaction, and assuming that a suitable reactor for pyrolysis can be suspended from a cable and lowered into the Heat Absorption Zone.

There is therefore a need to have an apparatus comprising a reactor for pyrolysis that can be raised and lowered on a cable into a well shaft and used with a source of geothermal heat.

An apparatus to drill wells deep enough to perform high temperature pyrolysis may present additional complications. Drilling into the Earth, especially for oil exploration, has developed significantly over the previous century. From the initial rotary rock bit developed in Texas in the 1900s to the more advanced tricone bits in the mid century, improvements have been made both in design and in materials for fabrication.

These drilling technologies, however, still rely on the friction of metal against rock, and use force from above as well as cutting and pinching motions in the bit itself to break away pieces of the rock being penetrated. This can be fine for softer soils and rock, but for drilling through harder layers, such as granite, the drill bits quickly wear out and break, and must be withdrawn and replaced for drilling to continue.

Drilling techniques that induce spallation have therefore recently been proposed. These involve the rapid and sudden heating of the surface of the rock in the borehole. The sudden temperature gradient creates stress fractures in the rock, and continued application of heat causes rock fragments, called spalls, to break off. Continued application of the heat allows the hole to be drilled without significant grinding or mechanical effort.

The initial spallation drilling techniques used open flames to create the temperature gradient, but a flame cannot be sustained in a borehole filled with mud or water. The recent development of Potter Drilling, as described in U.S. Pat. No. 8,235,140, (METHODS AND APPARATUS FOR THERMAL DRILLING, filed by inventors T. Wideman, J. Potter, D. Dreesen, and R. Potter and assigned to Potter Drilling, inc. of Redwood City, Calif.) involves directing a hot fluid, such as water, with a temperature about 500° C. above the ambient temperature of the material, onto a surface of the material being drilled. Spallation occurs, regardless of whether oxygen is present in the hole. After breaking away, the spalls are then pumped to the surface along with the used water from the process.

Although Potter Drilling has been demonstrated, there are some problems with the system. Most notably, providing a source of 500° C. fluid from the surface and insuring that its temperature does not drop as it travels down a well that can be kilometers deep requires a special tubing system capable of high temperatures and pressures. Likewise, energy must be expended pumping the spalls and spent water form the system.

There is therefore a need for a spallation system that has a local heating mechanism, and a local storage system for the spalls and debris that are created while drilling wells deep enough in rock that is hot enough to be suitable for efficient pyrolysis.

If a source of magma, such as a lava dome, can be tapped through a geothermal well, variations on the usual pyrolysis reactions have been observed. In particular, the carbon-based biomass reacts chemically with the minerals in the magma. Because of the high temperatures involved, the reaction products favor the production of gasses, including hydrogen $H_2$, carbon monoxide CO, carbon dioxide $CO_2$, and methane $CH_4$. When the biomass is mixed with water, or has a naturally high water content, large amounts of steam are also generated.

However, access to a lava dome is not an everyday occurrence. Very high temperatures are involved, and if magma is to be used as a heat source, the biomass to be converted must be supplied in a controlled manner.

There is therefore a need to have an apparatus comprising a means for facilitating pyrolysis that can interact with a lava dome.

BRIEF SUMMARY OF THE INVENTION

One embodiment of invention disclosed with this application is an apparatus comprising a pyrolysis reaction chamber. In some embodiments the reaction chamber connected to second chamber to contain the gas reaction products. In some embodiments, the reaction chamber is attached to a suspension mechanism to allow the reactor to be lowered into a well, where the pyrolysis reaction can be driven by geothermal heat.

One embodiment of the invention is a method and apparatus for spallation drilling using a local reservoir of molten salt as a heat source for a jet of a superheated fluid, such as water.

In some embodiments, the drilling apparatus can also comprise: chambers that contain the molten salt; a reservoir for the drilling fluid; and a chamber for containing the tailings, debris and spend drilling fluid that are generated.

An additional embodiment of the invention is an apparatus for the conversion of biomass to fuel gasses using the heat of a lava dome. The apparatus comprises a special magma reaction head that allows the mixing of magma and the biomass. Such a magma reaction head for the apparatus comprises three elements—a means of supplying a source of biomass, a diffusion chamber in which the biomass and magma can react, and a means of collecting the gasses that are produced by the reaction.

Note that the illustrations provided are for the purpose of illustrating how to make and use the invention, and are not to scale. The wells are anticipated to be kilometers deep, while the pyrolysis are expected to be typically 50 centimeters to 30 meters long and from 10 to 100 centimeters in diameter, and can be scaled to be other sizes and shapes if desired.

DETAILED DESCRIPTIONS OF EMBODIMENTS OF THE INVENTION

Pyrolysis Embodiments

Figure 1:
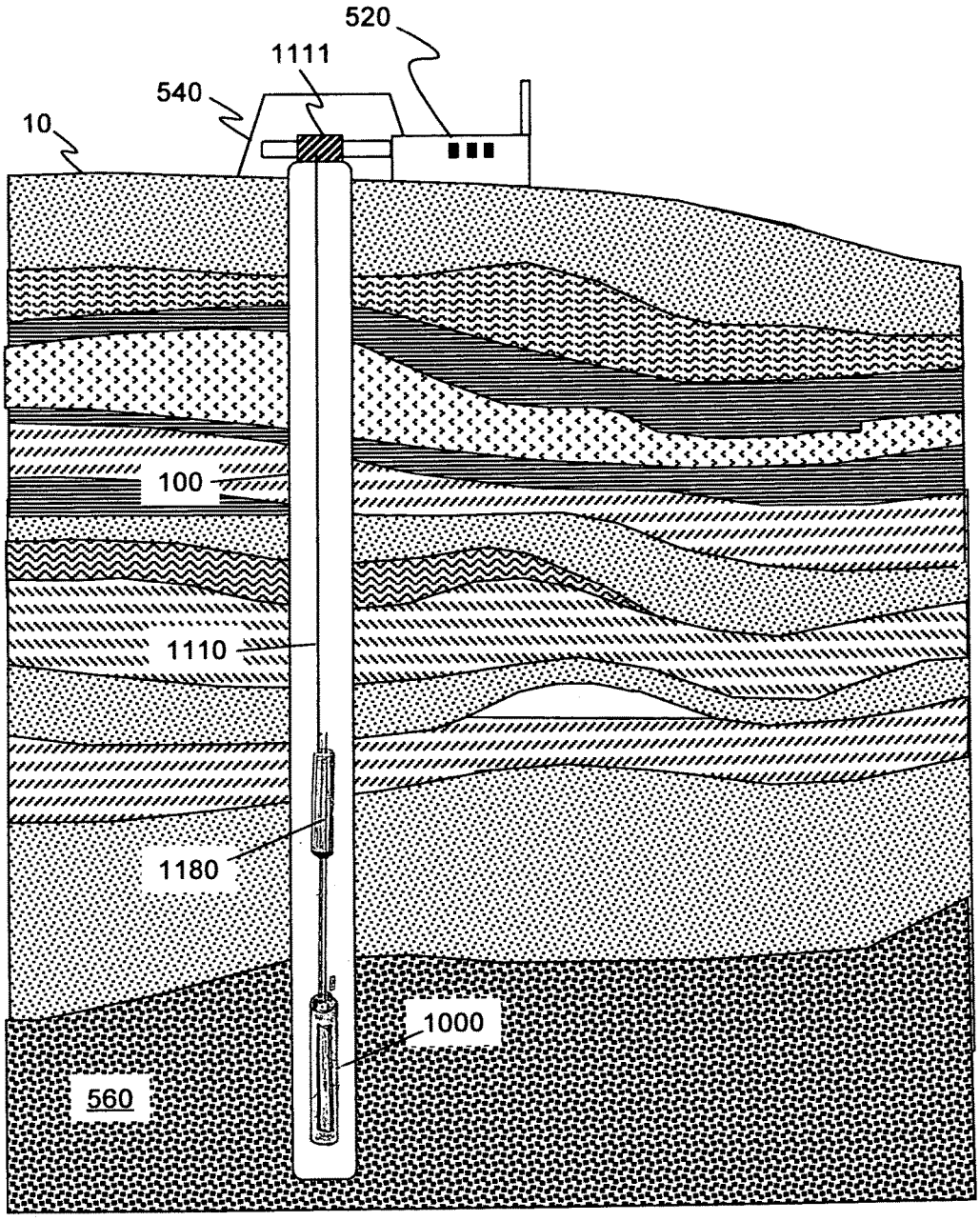
FIG. 1 illustrates a pyrolysis reaction chamber according to the invention lowered into a geothermal well.
Figure 2:
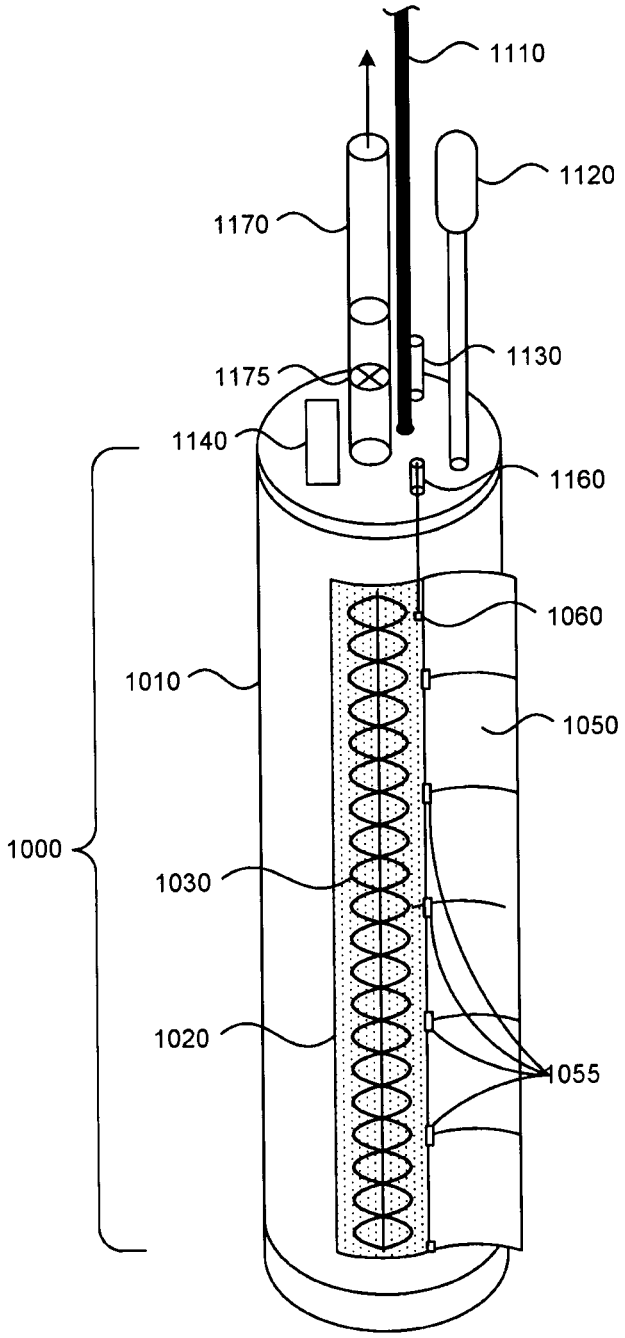
FIG. 2 illustrates a reaction chamber of a geothermal pyrolysis reaction system according to the invention.
Figure 3:
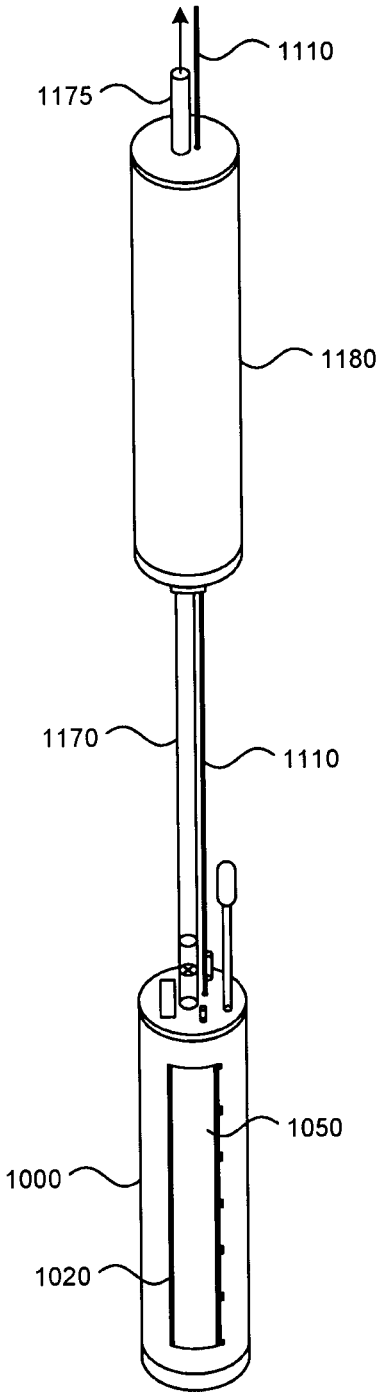
FIG. 3 illustrates a pyrolysis reaction system, comprising a reaction chamber and a gas products chamber separated by some distance according to the invention.

An embodiment of a pyrolysis reactor for use in a geothermal well is shown in FIGS. 1-3. In FIG. 1, the pyrolysis reactor 1000 and a storage chamber 1180 are suspended by a cable 1110 in a well shaft 100 which extends down into the Earth to a Heat Absorption Zone, designated as being within a thermal pool 560. The reactor 1000 will typically be loaded in a facility 520 at or near the surface of the Earth 10, and the facility 520 may have, or be connected to, a structure 540 that has control mechanisms 1111 that may raise and lower the reactor 1000.

Generally, boreholes are expected to be round in shape, and so a cylindrical geometry for the reactor 1000, as illustrated in FIGS. 2 and 3, may be a better fit to maximize heat absorption.

The various elements of one embodiment of the pyrolysis reactor 1000 according to the invention as illustrated in FIGS. 2 and 3 are as follows. In some embodiments, the reactor module may comprise an outer shell 1010, which will generally be fabricated from a heat resistant material, such as stainless steel coated with nichrome, and several chambers, such as a reactor chamber 1020, a gas product storage chamber 1180, and a cover gas reservoir 1120. One chamber, the reactor chamber 1020, will have an aperture, such as a door or portal 1050, which can be opened to allow access to the interior of the chamber.

The interior can then be filled with the material to be processed, which can be any bio-mass, such as plant stalks, wood chips, sewage, compost, or any other carbon-containing waste products designated to undergo pyrolysis. The aperture 1050 can typically be designed so that the when closed, it forms an airtight seal, and may therefore have gaskets, o-rings, flanges, or other such means for sealing the aperture. In some embodiments, the door 1050 will have hinges 1055 that allow the door 1050 to open, and in other embodiments may have a sliding mechanism with various seals to secure the contents.

The reactor chamber may also contain internal mechanisms 1030 such as a mixing or stirring apparatus (e.g. a screw mechanism) to stir the contents of the reaction chamber 1020 as the pyrolysis occurs. In some implementations, a catalyst or other substance such as sand can be inserted into the reaction chamber along with the biomass. When stirred, a particulate substance such as sand grinds any already pyrolyzed surface off the biomass particles and exposes the un-pyrolyzied material underneath as the reaction progresses, potentially increasing the reaction speed.

At the top of the pyrolysis reactor 1000, in some embodiments there will be a motor 1140 attached to the reactor chamber to drive the internal mechanisms 1030 (such as the stirring apparatus). In other embodiments, the motor 1140 driving the internal mechanisms 1030 will be distant from the reaction chamber, and the mechanical motion conveyed through a cable or other coupling mechanism.

In some embodiments, this reactor chamber 1020 will also have a means for evacuation, such as an evacuation valve 1130 and possibly an attached pipe or other fixtures, which will allow the air to be pumped out of the reactor chamber 1020, since most pyrolysis reactions only occur in the absence of oxygen. At the top of the pyrolysis reactor 1000, in some embodiments there will be one or more suspension cables 1110 to lift and lower the pyrolysis reactor 1000 while in the thermal well.

The reactor chamber 1020 may also be provided with a second valve that can be used to fill the chamber with a cover gas provided by a reservoir of a cover gas 1120 such as nitrogen, argon, or some other gas mixture, at a predetermined pressure. In some embodiments, a single valve can be used to both evacuate the chamber, and then fill the chamber with a suitable cover gas. In other cases, a multiplicity of valves can be provided to provide several different gasses to be mixed for use as a cover gas. This cover gas pressure and mixture may be specifically adjusted to facilitate the pyrolysis reaction outcome. In some embodiments, the cover gas pressure and mixture can be adjusted as the reaction is taking place as well. In some embodiments, a tank or multiplicity of tanks containing a supply of cover gas ingredients will be provided within the reactor module, so the pressure and composition of the cover gas can be adjusted as the reaction progresses.

As the pyrolysis reaction progresses, some of the reaction products are gasses, sometimes called syngas. In some embodiments, one or more sensors 1060 can be mounted within the pyrolysis chamber to monitor properties such as temperature, pressure, reaction rates, concentrations of particular reaction products, internal gas composition, and the like. To enable these to be monitored as the reaction progresses, the sensors 1060 may be connected by a sensor access connector 1160 which in turn may be connected to the surface through a communications cable. This communications cable may be attached to the suspension cable 1110, or it may be distinct.

Control circuitry can direct various pumps to turn on and off as needed to move some or all of these reaction products out of the reaction chamber through a pipe 1170 comprising valves 1175 and into a second chamber, such as a bio-gas storage tank 1180, designed to hold the gas products, as shown in FIG. 3. In some embodiments, this bio-gas storage tank 1180 may house a pumping and condensing unit to speed up the transfer of gasses to the tank 1180, or to pump the gasses on to a second bio-gas storage unit either higher in the shaft or in the surface facility.

In some embodiments, the biogas storage unit 1180 may be significantly distant from the reactor 1000, since subjecting these gasses once produced to the same level of heating needed to drive the pyrolysis reaction may be detrimental. An embodiment of the reaction module in this case can comprise two separate chambers, the reaction chamber 1000 and the gas product chamber 1180, separated by some distance and connected by hoses 1170 or conduits. In some embodiments, these hoses 1170 or conduits may be provided with a mechanism that can spool the hoses, so that the reaction chamber and the gas product chamber are close together when near the surface, but are far apart when lowered to the Heat Absorption Zone.

In some embodiments, the biogas product storage chamber 1180 can be as far away as the top of the well shaft, on the surface of the Earth, and the hoses and conduits that connect the gas product chamber and the reactor chamber can extend the entire length of the well shaft. This is illustrated in FIG. 3. In this embodiment, once the reaction gasses are removed, the reactor 1000 itself may have significantly less weight, and therefore require less energy to bring to the surface once the pyrolysis reaction has been completed.

In the embodiments in which the reaction chamber and the gas product chamber are separated and connected by hoses or conduits, it may be very advantageous to have those hoses and/or conduits well insulated, since the gas products of pyrolysis may themselves be very hot. In addition the mechanisms described here, a means to extract the heat energy from the reaction products for the generation of electricity or other industrial processes may be desired. In some embodiments, the suspension cable 1110 will support the biogas storage tank as well as the reactor 1000. In some embodiments, the biogas storage tank 1180 will have its own suspension cable.

It will be known to those skilled in the art of pyrolysis that various recipes for pyrolysis can be used, depending on the material being used and the reaction products desired. Slow pyrolysis, in which temperatures of 400° C.-450° C. are typically used and the temperature increase tends to be slower and more uniform, tend to produce more bio-char. Fast pyrolysis, in which the materials undergoes a very rapid temperature increase to over 500° C., generates a larger proportion of bio-oil and syngas.

In a system according to the invention, various programmable pyrolysis reaction protocols can be achieved simply by raising or lowering the reaction module higher or lower in the Heat Absorption Zone, or into and out of the Heat Absorption Zone. Complex temperature exposure profiles can be arranged depending on the ambient temperature in different portions of the well shaft and the motion control of the reaction module.

In some embodiments, a sensor or network of sensors may be installed in or around the various chambers of the reaction module to monitor the temperature, pressure, or other reaction parameters. The signals from these sensors can be used to control and monitor the reaction if a programmable pyrolysis reaction using various temperatures and/or pressures is to be used.

In some embodiments, the entire pyrolysis apparatus is self-contained, meaning that the reaction chamber is loaded at the surface and sealed, and the reaction can progress once the reactor module has been lowered into the well without manual intervention.

It should also be noted that steel cables, although strong and well established in the art, can be heavy and may not provide the optimal performance as suspension cables for the pyrolysis reactor. over time because the temperatures required for pyrolysis are generally high, so the wells will be typically deep, and for a long cable the weight of the cable itself may become significant. New innovations in synthetic cables, such as cables manufactured from para-aramid fibers such as Twaron® or Technora® by the company Teijin Aramid (based in Arnhem, the Netherlands) are lightweight, and may serve better for deep wells with certain temperature profiles. Other synthetic cables, such as those manufactured by Cortland Cable of Cortland, N.Y., or high temperature cables for sensors from York Wire and Cable of York, Pa. may also be suitable for certain uses in the design and employment of thermal masses. In any case, for high temperature wells, some amount of cable insulation may be desired.

It should be noted that, once the pyrolysis reactor is brought again to the surface so that the chamber can be emptied and the apparatus cleaned and serviced, it is expected that the equipment will still be very hot. The heat can be harvested in the same manner as disclosed in the patent application cited above, with the transfer of heat to a thermal reservoir and the subsequent conversion of that heat to generate electricity.

Figure 4:
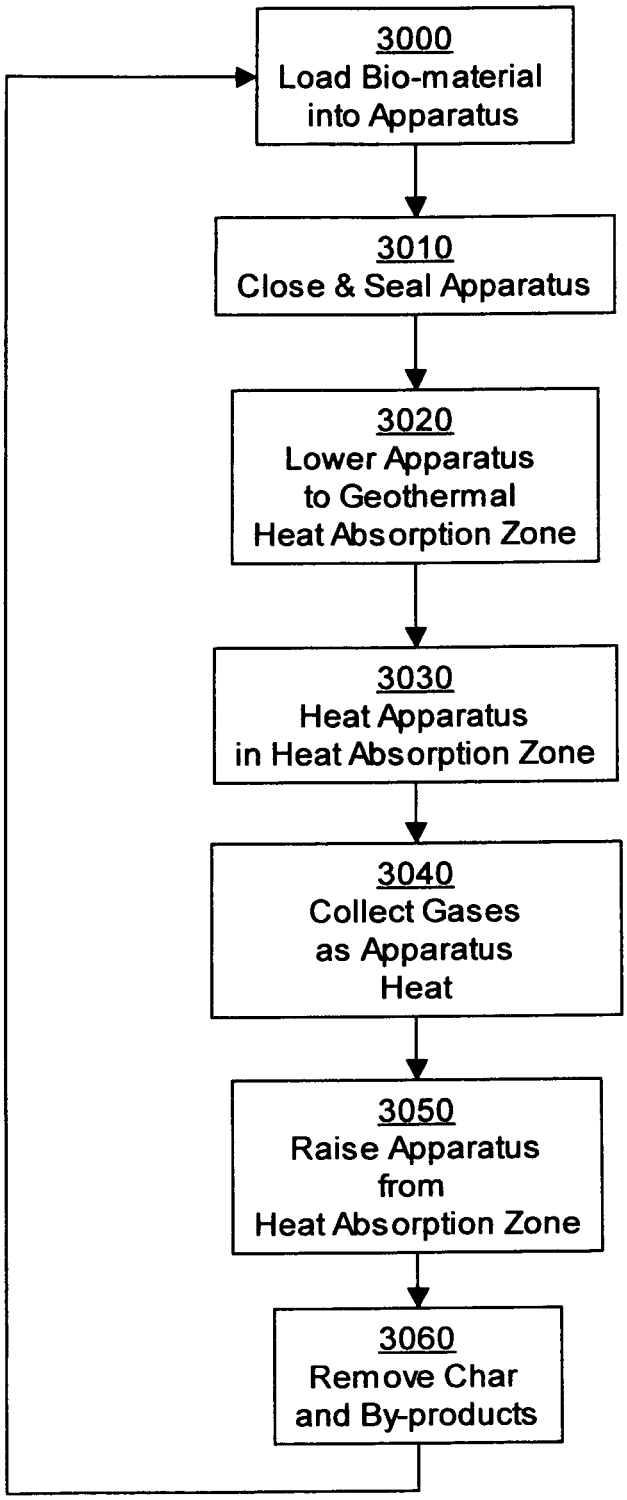
FIG. 4 illustrates a flow chart according to one embodiment of the invention for geothermal pyrolysis conducted inside a well.

The steps of an embodiment of a method for carrying out pyrolysis are illustrated in the flow chart of FIG. 4. In the first step 3000, the bio-material is loaded into the pyrolysis apparatus. Sand and other materials may also be loaded into the chamber. In the next step 3010, the apparatus is closed and sealed.

Once sealed, in the next step 3020 the loaded apparatus is lowered into the geothermal Heat Absorption Zone, and is left to heat up. As this occurs, in the next step 3040 the biogases will begin to be released, and can be collected in the biogas storage unit.

In the next step 3050, once either a pre-determined time has elapsed, or sensors inside the reactor indicate that a certain result has been achieved, the reactor is raised from the well back to the surface of the Earth. The chamber is opened, and in the next step 3060 the solid reaction products removed, and whatever cleaning that needs to take place can be done. Then, once the reaction chamber is clear, the entire process can be repeated again Counter-balanced Pyrolysis.

As described in the previously cited patent application, the energy extraction system using thermal masses can be more efficient if there are two nearby wells, and two connected thermal masses are attached to each other by a cable and arranged in their respective wells in a counter-balance arrangement. Therefore, when one thermal mass descends under the force of gravity, it pulls the other thermal mass up from deep within its respective well. If the thermal masses are well balanced, this has the potential to allow energy extraction at reduced energy cost, since the only energy that needs to be added to the system is whatever is needed to overcome friction and air resistance, not what is needed to pull a thermal mass out of the well against gravity.

In a similar manner, such a counter-balance arrangement can be applied to embodiments of this invention as well. In some embodiments, there will be a pyrolysis reactor module on each end of a long cable, with each reactor suspended in its respective well. When one reactor is at the surface, the other is down its well, undergoing a pyrolysis reaction. Then, as the second pyrolysis reactor is lowered into the second well, the force of gravity pulling the second reactor down will be coupled through the cable to pull the first reactor up to the surface. This allows the pyrolysis reactions to be carried out at a lower energy cost.

In some embodiments, the pyrolysis reaction will produce gasses that are lighter than air. In this case, means can be provided to extract the gasses, so that the remaining solid reaction products will be significantly lighter than the materials inserted into the well. It may therefore require less energy to bring them to the surface, and the counter-balance system may in fact generate excess energy. Means can therefore be provided in some embodiments to also couple the cable mechanism to a generator to allow the excess energy generated by the descending pyrolysis reactor to be stored for future use or for distribution on the electrical grid.

Surface-based Pyrolysis.

Other embodiments of the methods of the invention may include harvesting geothermal heat from inside the Earth, and using surface facilities to carry out the pyrolysis reaction. This can be done, for example, by using the geothermal energy harvesting methods previously disclosed in the above mentioned patent application of McBay.

Figure 5:
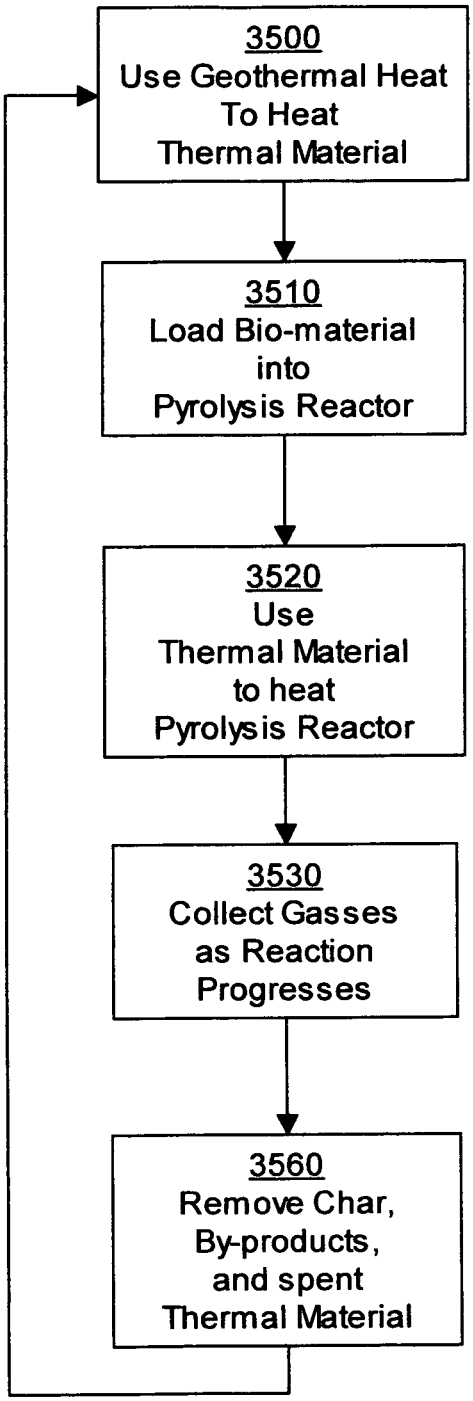
FIG. 5 illustrates a flow chart according to one embodiment of the invention for geothermal pyrolysis conducted at the surface.

Steps for one embodiment of the invention are shown in FIG. 5. In the first step 3500, geothermal energy is harvested from the Earth by heating up a volume of a thermal material, for example, bringing up volumes of heated molten salt. In the next step 3510, the bio-materials are prepared in a reaction chamber or vessel. In the next step 3520, the thermal material heats the pyrolysis reactor. As this occurs, in the next step 3530, the biogases are given collected in a separate biogas collection chamber. Finally, once the gasses have been generated, in the last step 3060 the reactor is cleaned and prepared to go through the cycle again.

Figure 6:
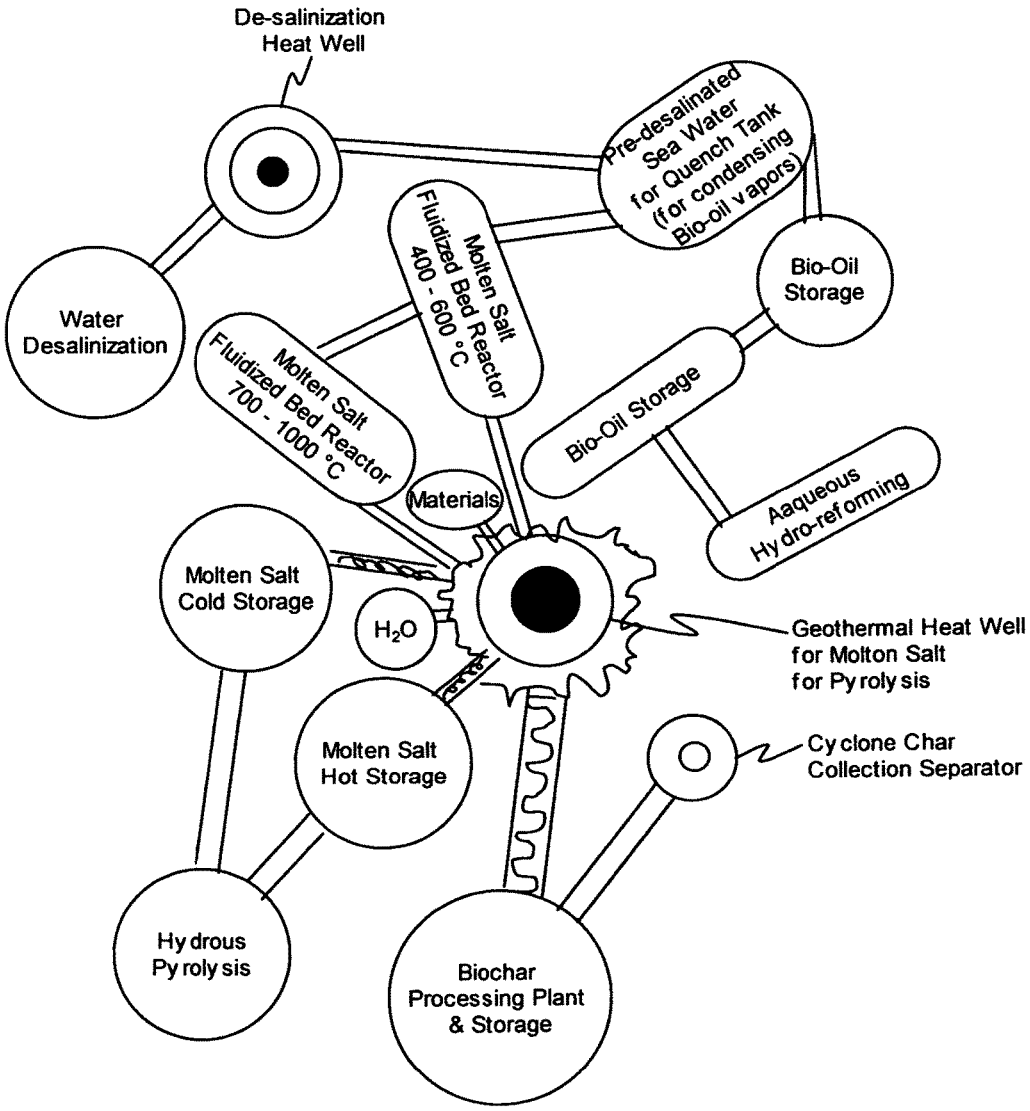
FIG. 6 illustrates a schematic geographic layout of multiple pyrolysis facilities arranged around a geothermal well.

In some embodiments, multiple pyrolysis facilities, as well as other facilities using geothermal energy (such as seawater desalinization) may be combined into a single geographic facility. FIG. 6 illustrates an overview from above of a hypothetical layout of a network of reactors, processing plants and storage facilities built around geothermal wells. Both pyrolysis and desalinization are represented here, but the illustration is not intended to be exclusive—other types of reactors may be able to be included in a network of plants built around geothermal wells as well, such as those used to generate electricity, etc.

It should also be noted that the drawing of FIG. 6 is provided for illustrative purposes only; an actual network of facilities may have fewer or additional facilities, and the layout may be adapted to the local geographic conditions, including the local topography, local water drainage and underground water table conditions, etc.

Magma-Based Pyrolysis

The embodiments described so far using geothermal heat to drive pyrolysis reactions will typically be used with medium temperatures (e. g. <500° C.). However, in certain geographic regions, such as along plate boundaries or near active volcanoes, there are regions that have hotter temperatures relatively close to the surface. There are therefore other embodiments of the invention that incorporate the geothermal heat from magma to induce pyrolysis.

When magma is close to the surface, it often forms chambers in the Earth in the form of lava domes. In order to drill a well into a lava dome, special drilling apparatus may be needed that are designed to operate at high temperatures. The spallation drilling system disclosed below may be an apparatus especially useful for drilling at high temperatures.

A Spallation Drilling Apparatus.

The spallation system disclosed here comprises a drilling unit designed for insertion into a well while suspended from a cable. The drilling unit may be secured to the wall of the well shaft using an inflatable bladder that anchors the drilling rig to the side wall. In one embodiment, the drilling unit has an internal structure comprising several distinct chambers, one to contain a thermal reservoir, one to contain drilling fluid, and another to contain waste debris. These chambers may all be in the same vessel, or partitioned between two or three distinct vessels that are coupled together.

Figure 7:
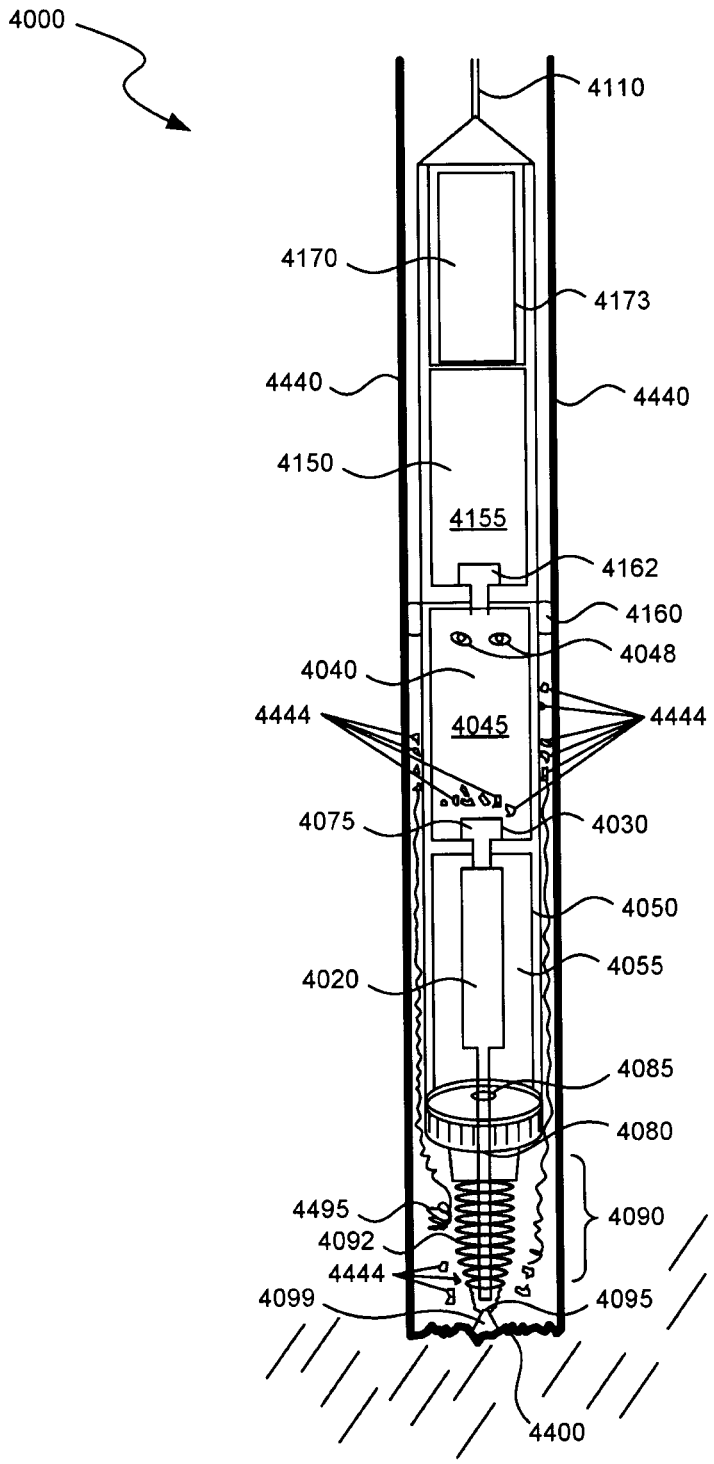
FIG. 7 illustrates a spallation drilling apparatus according to the invention.
Figure 8:
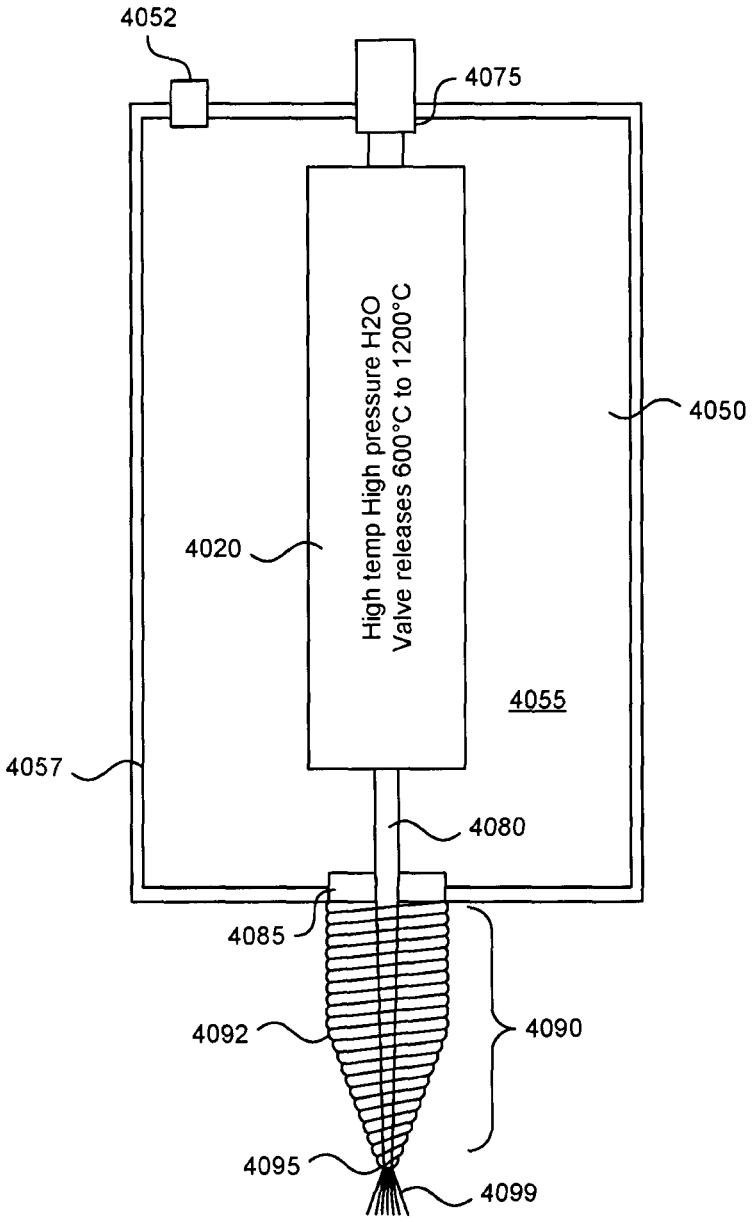
FIG. 8 illustrates in more detail the interior structure of the drilling apparatus illustrated in FIG. 7.

FIGS. 7 and 8 illustrate an embodiment of a drilling unit according to the invention.

In this embodiment of the invention, the drilling unit 4000 has a chamber, called a thermal chamber 4050, which is designed to hold a thermal material 4055, such as molten salt, typically at temperatures of 400-650° C. but which can be as hot as 1,200° C. The thermal material 4055 (i.e. molten salt) is loaded into the thermal chamber 4050 at the surface using an access valve 4052, and the thermal chamber 4050 is then closed. The thermal chamber 4050 can be designed with insulation 4057 to prevent the molten salt from cooling.

Sensors such as thermocouples that measure temperature can be provided throughout the unit 4000 to monitor the temperature of the salt and determine when the unit needs to be brought to the surface to be recharged. These sensors may monitor variables such as the temperature of the thermal chamber, the weight balance of the tailings in the debris chamber, the flow rate of the drilling fluid, etc. A control unit 4170 for the sensors may be provided as part of the drilling unit 4000, but if the unit 4170 and its electronics are close to the hot drilling zone, insulation 4173 may be required. In other embodiments, the sensor control unit or may be further up the shaft and connected by cables to the drilling unit. In either case, an additional data cable can be used in some embodiments to transmit the data to a controller, which can be either at the surface or mounted on the drilling unit itself. This data cable may be integrated with the suspension cable 4110, or it may be an independent cable.

As shown in FIGS. 7 and 8, inside the thermal chamber 4050 is a heating chamber 4020 for heating the drilling fluid, with a connection 4075 on one side to a reservoir 4040 containing a supply of the drilling fluid 4045, and a connection 4085 to the drilling head 4090 on the other side. Normally, the drilling fluid reservoir 4040 is outside the molten salt chamber 4050, and the drilling fluid 4045 is at ambient temperature. When needed, a pumping system 4030 will transfer drilling fluid 4045 into the heating chamber 4020, where it heats up when surrounded by the hot molten salt 4055. If the drilling fluid 4045 is water, the water becomes a superheated $H_2O$ plasma under high pressure and temperatures when in the heating chamber.

In some embodiments, the connection 4075 between the drilling fluid reservoir 4040 and the heating chamber 4020 is designed using a one-way valve 4075, so fluid 4045 will only enter the heating chamber 4020 from the reservoir 4040, but there is no chance for the heated fluid to flow back into the reservoir 4040.

Once heated, the hot drilling fluid is then released through the connector 4085 out the other end into the drilling head 4090, which contains a nozzle 4095 to direct a jet 4099 of the heating fluid onto the surface of rock to be drilled 4400. In some embodiments, the drill bit 4092 will be a high temperature material such as silicon carbide or boron carbide. The drill head 4090 will have a hollow pipe 4080 that carries the hot drilling fluid from the reservoir 4020 to the nozzle 4095 at the end of the drilling head 4090. The drilling head 4090 may have a single nozzle 4095 that produces a jet 4099, or may have multiple nozzles that jet the hot drilling fluid in several directions.

The high temperature jet 4099 of drilling fluid hitting the cooler rock face 4400 creates spalls 4444 at the surface of the rock, which break off.

As the drill progresses, the combination of drilling fluid and spall debris 4495 will surround the drilling head 4090 and move up the side of the well. In some embodiments of the invention, the drilling unit 4000 has an additional debris chamber designed to collect the debris and tailings and store them. In the embodiment shown, the drilling fluid reservoir 4040 serves as the debris chamber. In the embodiment shown, the drilling unit 4000 comprises an additional chamber 4150 with is filled with a fluid to supply a hydraulically filled stabilizer bladder 4160. A pump 4162 for the bladder 4160 may also be provided to transfer the fluid. This bladder 4160 additionally serves to anchor the drilling unit 4000 to the shaft wall 4440 and prevent rotation as the drilling proceeds.

Once inflated, the bladder serves to form a seal between the top of the drilling mechanism and the rock wall of the well shaft, forcing the debris 4495 surrounding the drilling head 4090 into one-way apertures 4048 for the debris chamber or, in this embodiment, into the drilling fluid reservoir 4040 (which becomes emptier as the drilling fluid is consumed).

When the debris/reservoir chamber 4044 is full of spalls 4444 and the drilling fluid has all been used, the drilling unit 4000 needs to be pulled up to the surface. When this occurs, the debris will then be brought up as well, eliminating the need for an additional pumping system to evacuate the well.

In some embodiments, the head 4090 of the drilling apparatus 4000 can also be fitted with a conventional drill bit (not illustrated), to provide additional force to break fragments of rock off the surface. In some embodiments, the drill bit can be fabricated from silicon carbide. In some embodiments, the drill bit can be a screw-type drill bit. In some embodiments, the drill bit will be a bicone drill bit. In some embodiments, the drill bit can be a tricone drill bit.

In some embodiments, the drill bit will be mounted so that the drill bit can extend away from the thermal chamber and into the drilling zone. It can also be mounted so that it can rotate to drill in different portions of the well shaft. In some embodiments, the jet of the drilling fluid and the drill bit can be independently controlled, so the rock faces they are addressing can be independently adjusted.

In the embodiment shown, the drilling unit 4000 will be suspended by a cable 4110 and anchored with the inflatable bladder 4160. The suspension cables will typically be steel. However, it should be noted that steel cables, although strong and well established in the art, can be heavy and may not provide the optimal performance as suspension cables over time for wells in which the temperatures are high. New innovations in synthetic cables, such as cables manufactured from para-aramid fibers such as Twaron® or Technora® by the company Teijin Aramid (based in Arnhem, the Netherlands) are lightweight, and may serve better for deep wells with certain temperature profiles. Other synthetic cables, such as those manufactured by Cortland Cable of Cortland, N.Y., or high temperature cables for sensors from York Wire and Cable of York, Pa. may also be suitable for certain uses in the design and employment of thermal masses. In any case, for high temperature wells, some amount of cable insulation may be desired.

Counter-balanced Drilling Heads

In a previous patent application entitled GEOTHERMAL ENERGY COLLECTION SYSTEM, U.S. patent application Ser. No. 13/815,266, submitted on Feb. 14, 2013 and incorporated herein in its entirety by reference, inventions by David Alan McBay, the inventor of the invention disclosed here, are presented. These disclosed inventions comprise a system in which a thermal mass is lowered into a well to a Heat Absorption Zone, which will typically be a stratum of the Earth geothermally heated to 350° C. or more. While in this Zone, the temperature of the thermal mass rises because it is surrounded by the Earth's heat. Once hot, this thermal mass is then raised again to the surface, and the heat transferred in a Heat Transfer Zone to a suitable means for driving an industrial process, such as the generation of electricity or powering a chemical reaction or another industrial process.

As described in the above cited patent application, the energy extraction system using thermal masses can be more efficient if there are two nearby well holes, and two connected thermal masses are attached to each other by a cable and arranged in their respective in a counter-balance arrangement. Therefore, when one thermal mass descends under the force of gravity, it pulls the other thermal mass up from deep within its respective well. If the thermal masses are well balanced, this has the potential to allow energy extraction at reduced energy cost, since the only energy that needs to be added to the system is whatever is needed to overcome friction and air resistance, not what is needed to pull a thermal mass out of the well against gravity.

In a similar manner, such a counter-balance arrangement can be applied to embodiments of this invention as well. In some embodiments, there will be a drilling unit on each end of a long cable, with each drilling unit suspended in its respective well. When one drilling unit is at the surface, being emptied or filled, the other is down in its well, drilling the well further. Then, as the second drilling unit reactor is lowered into the second well, the force of gravity pulling the second drilling unit down will be coupled through the cable to pull the first drilling unit up to the surface. This allows drilling to be carried out at a lower energy cost.

As the drilling progresses, the debris and tailings that accumulate may weigh a significant amount, and the changing weight and weight distribution needs to be considered in the design of the drilling units, especially if a counter-balance system is to be employed.

A Magma-based Pyrolysis Apparatus.

Figure 9:
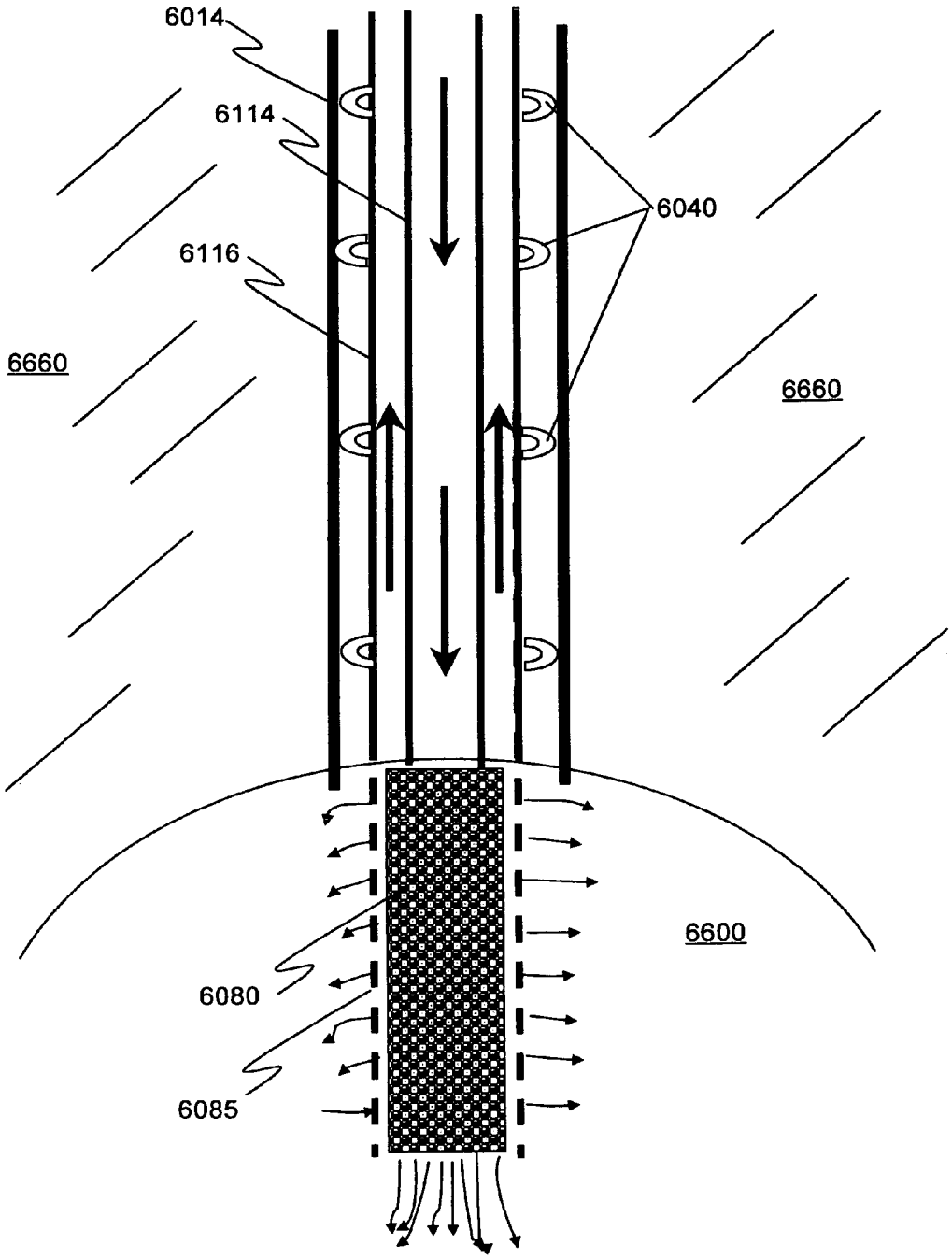
FIG. 9 illustrates an apparatus for carrying out pyrolysis using a lava dome according to the invention.

One embodiment of the invention is illustrated in FIG. 9. Once a well shaft 6014 has been drilled into the Earth 6660 using, for example, the high temperature spallation apparatus just described, and a lava dome 6600 penetrated, an apparatus for pyrolysis is inserted into the shaft lowered to the magma. The apparatus will be connected with the surface with various hoses, pipes or other conduits to supply the biomaterial and retrieve the reaction products.

Unlike the previous embodiment, which used a pyrolysis chamber immersed in a hot well to conduct pyrolysis, this embodiment uses the magma itself as an active ingredient in the pyrolysis process. The apparatus in this case is a much simpler unit that supplies the biomass to the magma, and provides an exit path for the gas products to be returned to the surface. This embodiment has the advantage that the solid reaction products are dissolved into the magma, and therefore need not be cleaned from a reaction chamber.

The lower portion of the apparatus 6080 can comprise apertures to allow the magma to surround the outermost shell of the apparatus. This lower portion 6080 in some embodiments may be extendable and retractable, so that the material being provided for pyrolysis does not "freeze" at the entrance to the magma dome 6600, causing the process to stop as the pipe clogs.

Such a magma reaction head for the apparatus typically will comprise three parts—a means of supplying the biomass (often provided in a 50/50 mixture with water), a diffusion chamber in which the biomass and magma can react, and a means of collecting the gasses that are produced by the reaction. The apparatus may also comprise supports 6040 that may be in the form of annular shaped seals that surround the apparatus. These seals may expand to fill the space between the apparatus and the wall of the shaft 6014, providing a seal that prevents the generated gas from rising outside the apparatus.

In this embodiment, the apparatus comprises concentric tubes. In the innermost tube 6114, typically 20-30 cm in diameter, biomass comprising carbon-based material is provided to the magma. The biomass material can be mixed with water to provide a slurry (typically in a 50/50 mixture with water), or can be naturally high in water content. At the bottom of the inner tube 6114, the biomass flows down and out into a larger volume 6080, typically as large as the external diameter of the pipe, which may be about 1 meter in diameter. The outer boundary 6085 of this part of the pipe will be manufactured from a material which will not melt in the magma, typically carbon fiber or silicon carbide, and in some embodiments comprises a pattern of perforations which forms a diffuser that allows magma to enter the lower end of the pipe and mix with the biomass.

Once the magma and biomass mix, they undergo thermally driven chemical reactions. In the absence of oxygen $O_2$ and at the high temperature of the magma, and the majority of the carbon-based compounds becomes syngas, comprising steam $H_2O$, hydrogen $H_2$, carbon monoxide CO and carbon dioxide $CO_2$ and methane $CH_4$.

In the embodiment shown in FIG. 9, the outer part of the pipe 6116 has an annular shape, surrounding the inner pipe supplying the biomass. If the diameter of the inner pipe is, for example, 30 cm, and the outer pipe 100 cm, the cross sectional area of the annular exterior pipe for the return gasses will be approximately 10 times the inner pipe supplying the bio-mass.

The gas reaction products may generate enough pressure that they naturally rise to the surface in the outer pipe 6116; however, additional pumps may be needed to extract the gasses more rapidly.

Figure 10:
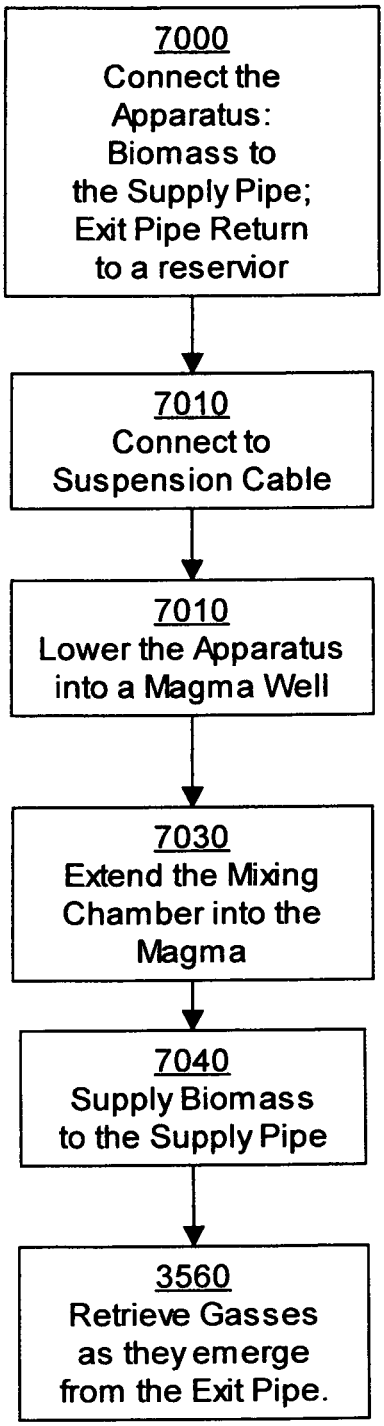
FIG. 10 illustrates a flow chart according to one embodiment of the invention for geothermal pyrolysis conducted in a lava dome.

The process is illustrated in the flow chart of FIG. 10. The first step 7000 is to connect the apparatus—the supply pipe to a supply of biomass, the exit pipe to a reservoir to receive the gasses. In the next step 7010, the apparatus is connected to a suspension cable and, in the next step 7020, is lowered into a well that connects to magma in a lava dome.

In the next step 7030, once the apparatus has been lowered in the well to make contact with the top of the magma, the end portion can be extended into the magma, forming a mixing chamber for the pyrolysis reaction. In the next step 7040, biomass is supplied to the supply pipe, where it mixes with magma in the reaction zone. Gases are produced, and in the last step 7050, are retrieved through the exit pipe.

This invention has a natural advantage over other approaches to pyrolysis in that the reaction is driven at hotter temperatures and therefore produces mostly gas. Solid waste from the process will be generated, but the solid material left behind, called char, will simply mix in with the magma and remain in the bowels of the Earth. Only the gasses return to the surface.

Although it is believed that simply providing a supply of biomass to the magma and a means to collect the gas products will drive the reaction, is may be fruitful to equip the apparatus with sensors such as thermocouples and pressure transducers, to monitor the temperature and pressure at various locations within the biomass delivery system. There is some concern that the sudden introduction of the relatively cold biomass/water mixture may locally freeze the magma it initially encounters. The frozen magma now blocks the flow, and the process stops. Introduction of the biomass at a controlled rate may therefore be very beneficial.

As described here, the entire apparatus will be suspended from a cable from the surface, with various hoses and conduits supplying the biomass and returning the gasses. Unlike the previously described embodiments, in which the weight of debris or the entirety of the reaction materials had to be returned to the surface, this embodiment, which relies on continuous supply of biomass, and which leaves the char behind in the magma, will be much lighter in weight. The cables and hoses, however, will need to be designed to endure the much higher temperatures encountered near a lava dome, and frequent inspection and maintenance for thermal damage or fatigue may be prudent.

ADDITIONAL USES AND LIMITATIONS

With this application, several embodiments of the invention, including the best mode contemplated by the inventors, have been disclosed. It will be recognized that, while specific embodiments may be presented, elements discussed in detail only for some embodiments may also be applied to others.

While specific materials, designs, configurations and fabrication steps have been set forth to describe this invention and the preferred embodiments, such descriptions are not intended to be limiting. Modifications and changes may be apparent to those skilled in the art, and it is intended that this invention be limited only by the scope of the appended claims.

What is claimed is:

1. An apparatus for pyrolysis in a geothermal well, comprising:

a reaction chamber comprised of thermally conductive material and configured to allow a pyrolysis reaction to occur, said reaction chamber comprising: at least one access port to load material, a means for evacuating oxygen from the chamber, a bio-mass, and select gases a means to suspend a reactor in a geothermal well; and a chamber to collect gasses from the reaction chamber given off by the pyrolysis reaction.

2. The apparatus of claim 1, additionally comprising a reservoir to hold gasses to be used as cover gasses for the pyrolysis reaction, and a means to transfer the gasses from the reservoir to the reaction chamber.

3. The apparatus of claim 1, in which the reaction chamber additionally comprises a means for mixing the contents of the reactor chamber.

4. The apparatus of claim 1, in which the reaction chamber and the gas collection chamber are separated and connected by a flexible hose.

5. A method for carrying out pyrolysis, comprising: designating a bio-mass to be pyrolyzed;

sealing the bio-mass into a reaction chamber comprising thermally conductive material, using geothermal heat to raise the temperature of the reaction chamber;

using select gases in the reaction chamber;

subsequent to sealing the bio-mass in the reaction chamber, using geothermal heat to raise the temperature of the reaction chamber, and using select gases in the reaction chamber, allowing a pyrolysis reaction to occur with the reaction chamber; and responsive to allowing the pyrolysis reaction, removing products of the pyrolysis reaction.

6. The method of claim 5, in which the reaction chamber comprises controls for a gas composition.

7. The method of claim 5, in which the step of using geothermal heat to raise the temperature of the reaction chamber comprises lowering the reaction chamber into a geothermal well.

8. The method of claim 5, further comprising:

storing the reaction products of the pyrolysis reaction.

9. The method of claim 5, in which the step of using geothermal heat to raise the temperature of the reaction chamber comprises heating a thermal material in a geothermal well;

removing the thermal material from the geothermal well; and heating the reaction chamber using the thermal material.

10. The method of claim 9, in which the thermal material is a salt.

11. The method of claim 10, in which the salt comprises potassium nitrate.

* * * * *